United States Patent [19]

Mashimo et al.

[11] Patent Number: 4,508,035

[45] Date of Patent: Apr. 2, 1985

[54] EXPLOSIVE CHARGING APPARATUS FOR ROCK DRILLING

[75] Inventors: Tohru Mashimo; Osamu Satoh, both of Hiroshima, Japan

[73] Assignee: Mazda Motor Corporation, Hiroshima, Japan

[21] Appl. No.: 467,837

[22] Filed: Feb. 18, 1983

[30] Foreign Application Priority Data

Feb. 19, 1982 [JP] Japan ..... 57-26461

[51] Int. Cl.[3] ..... F42B 3/00

[52] U.S. Cl. ..... 102/313; 102/312; 102/321; 86/20 C; 173/11; 299/13

[58] Field of Search ..... 102/312, 313, 321, 331; 173/4, 11, 43; 299/13; 86/20 C

[56] References Cited

U.S. PATENT DOCUMENTS

| | | | |
|---|---|---|---|
| 3,721,471 | 3/1973 | Bergmann et al. | 102/313 X |
| 4,040,355 | 8/1977 | Hopler, Jr. | 102/313 X |
| 4,230,189 | 10/1980 | Mashimo | 173/4 |
| 4,246,973 | 1/1981 | Mayer | 173/11 X |
| 4,356,871 | 11/1982 | Fujikawa | 173/11 X |

FOREIGN PATENT DOCUMENTS

| | | |
|---|---|---|
| 52-66998 | 6/1977 | Japan . |
| 53-48329 | 4/1978 | Japan . |

*Primary Examiner*—Peter A. Nelson

*Attorney, Agent, or Firm*—Fleit, Jacobson, Cohn & Price

[57] ABSTRACT

An explosive charging apparatus for charging controlled amount of explosives sequentially to bores drilled in a rock surface. The charging apparatus includes an explosive charging pipe, a boom mechanism carrying the explosive charging pipe, boom actuators for actuating the boom mechanism so that the explosive charging pipe is moved to a desired position, a control circuit for controlling the boom actuators and the explosive charging pipe. The control circuit includes a memory circuit having memories concerning locations, directions and depths of bores drilled in a rock surface, a processor for addressing memories of one of the bores in the memory circuit, a transducer for converting the addressed memories in the memory circuit to values of movements of the boom actuators, a servo control circuit for receiving outputs from the transducer and controlling operations of the boom actuators to locate the explosive charging pipe against one of the bores drilled in the rock surface, a charge depth setting device for setting a desired depth of explosive charging, a charge control circuit operable upon completion of operation of the servo control circuit for controlling the explosive charger so that explosives are charged to the desired depth in accordance with outputs of the charge depth setting device and applying a signal to the processor upon completion of explosive charging operation so that memories on another bore is addressed to perform another cycle of operation.

7 Claims, 9 Drawing Figures

EXPLOSIVE CHARGING APPARATUS FOR ROCK DRILLING

The present invention relates to a rock drilling, and more particularly to an automatically controlled explosive charging apparatus for charging explosives to bores drilled in a rock surface.

Hithertofore, it has already been proposed to control a rock drilling apparatus automatically in accordance with a memory of patterns of bores to be drilled on a rock surface so that the drill bit be placed sequentially against points on the rock surface where the bores are to be formed. For example, in Japanese patent application No. 52-66998 filed on June 7, 1977 and disclosed for public inspection on Feb. 5, 1979 under the disclosure No. 54-15403, there is disclosed a rock drilling apparatus including a drill rod having a drill bit attached to one end thereof and mounted on a guide cell for axial sliding movement. The guide cell is in turn supported on a boom mechanism comprised of a plurality of booms which are interconnected for articulated movements. Power cylinders are provided for controlling the guide cell and the booms so that the drill rod can be moved to any desired positions. The rock drilling apparatus disclosed in the Japanese application includes a control unit having a memory concerning locations in a rectangular coordinates of positions on a rock surface where bores are to be drilled. The control unit functions to address the memory of each position and convert the values in the rectangular coordinates into displacements of the power cylinders to thereby operate the cylinders to locate the drill bit at a desired position. Then, the power cylinder for advancing the drill rod is actuated to perform a drilling operation of a desired depth. The U.S. Pat. No. 4,230,189 also discloses a rock drilling apparatus in which drilling depths are automatically controlled so that all bores terminate at a desired plane.

In charging explosives into bores which have thus been formed conventional procedures have been to handle the explosives manually. However, such procedures are dangerous and require highly skilled labours. In fact, in order that a rock be broken effectively by a minimum amount of explosives, the explosives have to be charged to a part of the length of each drilled bore and such charging depth must be determined taking into account the location of the bore as well as the hardness of the rock. In view of the fact that the rock in the vicinity of the surface can easily be broken, the explosives must be charged from the bottom of the bore, leaving a certain distance from the rock surface uncharged. In case, for example, of tunnel construction, where excessive amount of explosives are charged, the result will be that too much rock materials are removed by explosion so that a lot of concrete material has to be used for finishing the tunnel wall. Thus, it is desirable to perform the explosive charging operations automatically. In order to automate such procedures, there has been proposed to provide an explosive charging pipe which is adapted to be inserted into a bore drilled in a rock surface and through which explosives are charged. For example, Japanese patent application No. 53-48329 filed on Apr. 25, 1978 and disclosed for public inspection on Nov. 1, 1979 under the disclosure No. 54-140706 shows such a type of explosive charging apparatus. However, such explosive charging apparatus is still inconvenient in that the charging pipe must be inserted into the drilled bores by mannal operations.

It is therefore an object of the present invention to provide an explosive charging apparatus which can perform explosive charging operations automatically in accordance with a memory of patterns of positions where bores are drilled.

Another object of the present invention is to provide an explosive charging apparatus by which explosives can be charged to a desired depth in a drilled bore.

A further object of the present invention is to provide a rock drilling apparatus which can perform not only drilling operations but also explosive charging operations automatically in accordance with a memory of a patterns of positions where bores are to be drilled.

According to the present invention, the above and other objects can be accomplished by an explosive charging apparatus for charging controlled amount of explosives sequentially to bores drilled in a rock surface, said charging apparatus including explosive charging means having explosive outlet means, boom means carrying said explosive outlet means of the explosive charging means, boom actuating means for actuating said boom means so that the explosive outlet means of the explosive charging means is moved to a desired position, control circuit means for controlling said boom actuating means and said explosive charging means, said control circuit means including memory means having memories concerning locations, directions and depths of bores drilled in a rock surface, means for addressing memories of one of the bores in said memory means, transducing means for converting the addressed memories in said memory means to values of movements of said boom actuating means, servo control means for receiving outputs from said transducing means and controlling operations of said boom actuating means to locate said explosive outlet means against one of the bores drilled in the rock surface, charge depth setting means for setting a desired depth of explosive charging, charge control means operable upon completion of operation of said servo control means for controlling said explosive charging means so that explosives are charged to the desired depth in accordance with outputs of said charge depth setting means and applying a signal to said addressing means upon completion of explosive charging operation so that memories on another bore is addressed to perform another cycle of operation.

In one mode of the present invention, the memory means includes memories of bottom positions of the bores as the memories concerning the depths of the bores, and the charge depth setting means includes bore depth operation means for performing operations based on the memories in the memory means to obtain actual bore depths, void depth setting means for setting lengths in the bores where the explosives are not to be charged and charge depth operation means for performing operations based on actual bore depth signals from the bore depth operation means and void depth signals from the void depth setting means to determine charge depths. The explosive outlet means of the explosive charging means may include charging pipe means which is mounted on the boom means for axial sliding movement and the boom actuating means includes an actuator for inserting and retracting the charging pipe means into and out of the bores.

In an alternative mode, the charge depth setting means includes percentage depth setting means for setting charge depth in percentage of the bore depth and charge depth operation means for performing operations based on actual bore depth signals from the bore depth operation means and percentage charge depth signals from the percentage depth setting means to determine charge depth.

According to another aspect of the present invention, there is provided a rock drilling apparatus comprising boom means, drilling means mounted on said boom means, first actuator means for moving said boom means so that said drilling means is located against a desired position on a rock surface, second actuator means for advancing and retreating said drilling means to perform drilling operations, memory means memorizing values in rectangular coordinates in an imaginary drilling plane of positions on the rock surface where bores are to be drilled, transducing means for converting the values in the rectangular coordinates memorized in the first memory means into values corresponding to positions of said boom means, servo control means for operating said first actuator means in accordance with signals from said transducing means, feedback means for feeding back values of movements of said boom means to said servo control means, drill control means operable under an output from said servo control means for operating said second actuator means to thereby control movements of said drilling means so that bores of desired depths are drilled, processing means for controlling operations of said memory means so that the values memorized in the memory means one sequentially addressed to thereby perform drilling operations sequentially in the positions on the rock surface where the bores are to be drilled, explosive charging means for charging explosives to the bores drilled in the rock surface, charge depth setting means for setting desired depth of explosive charging, charge control means for controlling said explosive charging means so that explosives are charged to the desired depth in accordance with outputs of said charge depth setting means. The drill control means may include bore depth setting means for setting depths of bores to be drilled. In one embodiment, the bore depth setting means includes bore bottom position setting means for determining distances of bore bottoms from the imaginary drilling plane, drill stroke operation means for performing operations based on said distances between the bore bottoms and the imaginary drilling plane and inclination angles of the respective bores with respect to the imaginary drilling plane to determine drilling strokes of the drilling means, and bore depth operation means for performing operations based on the drilling strokes and distances between the imaginary drilling plane and openings of the respective bores at the rock surface to determine actual bore depths. The charge depth setting means may include void length setting means for setting lengths from the openings of the respective bores where explosives are not to be charged and charge depth operating means for performing operations based on actual bore signals from the bore depth operation means and void length signals from the void length setting means to determine explosive charge depths.

The explosive charging means may include charging pipe means which is adapted to be mounted on the boom means in lieu of the drilling means and the memories in the memory means may be utilized to operate the first actuator means to locate the charge pipe means sequentially against respective ones of the bores. The second actuator means may then be used to move the charging pipe means into and out of the bore.

The above and other objects and features of the present invention will become apparent from the following descriptions of a preferred embodiment taking reference to the accompanying drawings, in which.

Figure 1:
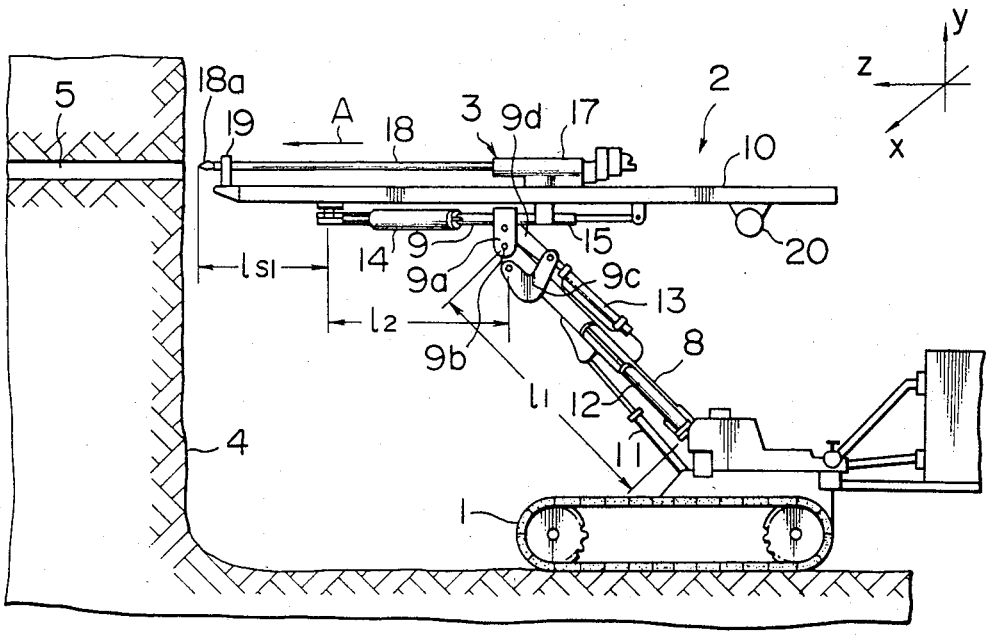
FIG. 1 is a side view of a rock drilling apparatus in accordance with one embodiment of the present invention.
Figure 2:
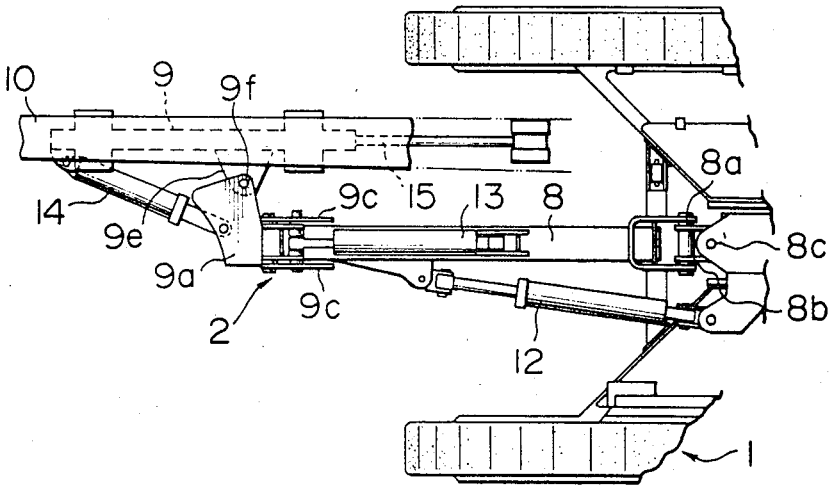
FIG. 2 is a plan view of the rock drilling apparatus shown in FIG. 1.
Figure 3:
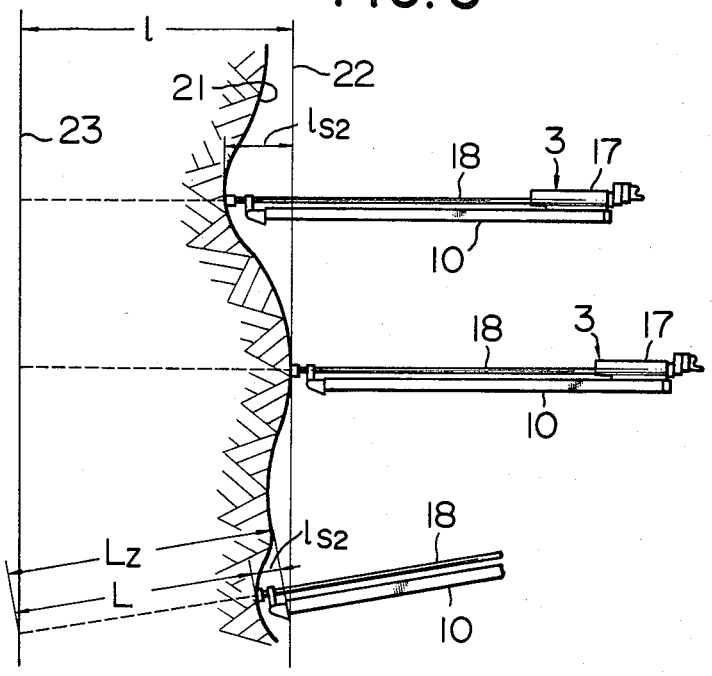
FIG. 3 is a diagrammatical view showing the imaginary drilling plane and the bore bottom plane.

Referring now to the drawings, particularly to FIGS. 1 and 2, there is shown a rock drilling apparatus including a crawler type vehicle 1 which is provided with a boom mechanism 2 for carrying a drill assembly 3. The boom mechanism 2 includes a first boom 8 connected for swinging movement about a horizontal axis 8*a* with a connecting bracket 8*b* which is in turn mounted on a body of the vehicle 1 for swinging movement about a vertical axis 8*c*. The first boom 8 has a free end provided with a swingable bracket 9*a* which is connected at one end with the boom 8 for swingable movement about a horizontal axis 9*b*. A pair of bellcrank arms 9*c* are mounted at one ends to the first boom 8 for swingable movement about a horizontal axis. The other ends of the bell-crank arms 9*c* are connected through a link 9*d* with the bracket 9*a*.

The first boom 8 is associated with a boom lift cylinder 11 for effecting a vertical swinging movement of the boom 8 as well as a boom swing cylinder 12 for effecting a horizontal swinging movement of the boom 8. Between the first boom 8 and the aforementioned other ends of the bell-crank arms 9*c*, there is a cell lift cylinder 13 which functions to control the swinging movement of the bracket 9*a*. As shown in FIG. 2, the bracket 9*a* is pivotably connected by a pin 9*f* with a bracket 9*e* which is secured to a second boom 9. A cell swing cylinder 14 is provided to extend between the bracket 9*a* and the second boom 9 to control the swinging movement about the pin 9*f*. The second boom 9 carries a guide cell 10 so that the guide cell 10 can move longitudinally along the second boom 9. For advancing and retracting the guide cell 10, a cell slide cylinder 15 is provided between the boom 9 and the guide cell 10. The drill assembly 3 includes a drifter 17 mounted on the guide cell 10 and a drill rod 18 extending forwardly from the drifter 17 along the guide cell 10. The drifter 17 is of a known structure and functions to apply an impact force to the drill rod 18. A driving motor 20 is provided to advance and retreat the drifter 17 along the guide cell 10. On the guide cell 10, there is provided a centralizer 19 which serves to guide the drill rod 18. A drill bit 18*a* is provided on the forward end of the drill rod 18. It will therefore be understood that by operating the cylinders 11 through 15 it is possible to locate the drill bit against a desired position on a rock surface 4 and to drill a bore 5 by operating the drifter 17 and the motor 20. It will further be understood that the desired position where the drill bit 18*a* be located can be represented by values in rectangular coordinates x, y, z as shown in FIG. 1 and that the coordinates values can be converted to swinging angles of the booms 8 and 9 and a distance $l_{s1}$ of advancement of the guide cell 10.

Figure 4:
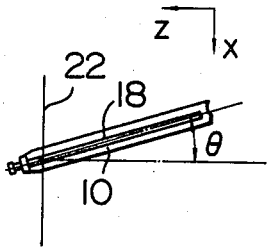
FIGS. 4 and 5 are fragmentary views showing obliquely directed drilling heads.
Figure 5:
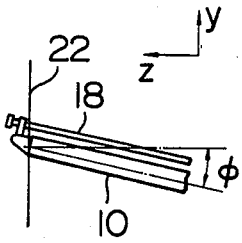
Figure 9:
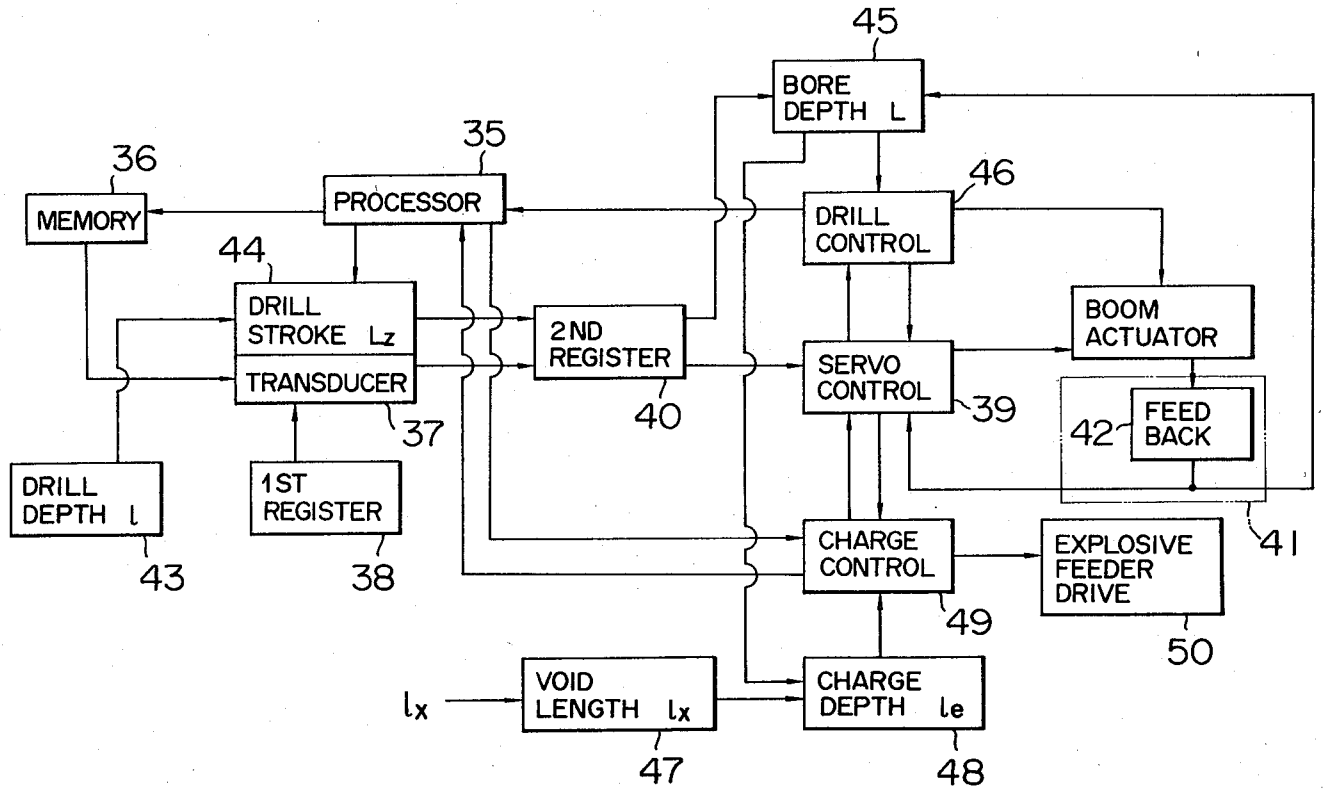

In order for governing the operations of the cylinders 11 through 15 so that the drill bit 18*a* be placed automatically and sequentially at the desired positions against the rock surface 5, there is provided a control circuit as shown in FIG. 9. The circuit includes a memory circuit 36 which contains memories of the values in the rectangular coordinates of the positions where bores are to be drilled. The output of the memory circuit 36 is connected with a transducer 37. A processing circuit 35 is provided to apply a signal to the memory 26 so that the memorized coordinates values of the desired positions are sequentially addressed and applied to the transducer 37. For performing a first drilling cycle, the processing circuit 35 applies a signal to the memory circuit 36 so that the memorized values corresponding to the first drill position are passed to the transducer 37. The transducer 37 functions to convert the values in the rectangular coordinates to the swinging angles of the first and second booms 8 and 9 and the distance $l_{s1}$ of advancement of the guide cell 10 taking reference to lengths $l_1$ and $l_2$ of the booms 8 and 9, respectively, which are applied to the transducer 37 by a first register 38. The output of the first transducer 37 is applied to a second register 40. There is also provided a bore depth setting device 43 which has a memory of the distance l between an imaginary drilling plane 22 and a bore bottom plane 23 in which bottoms of bores 5 are to be positioned. The output of the bore depth setting device 43 is applied to a drill depth operation circuit 44 which performs an operation based on the output of the setting device 43 taking into consideration the inclination angle $\theta$ in horizontal plane and the inclination angle $\phi$ in vertical plane of the drilling rod 18 with respect to the imaginary drilling plane 22 as shown in FIGS. 4 and 5. The operation in the circuit 44 is performed under the following formula.

$$L_z = l/(\cos\theta \cdot \cos\phi) \quad (1)$$

The output of the operation circuit 44 is applied to the second register 40. The values registered in the second register 40 is used to operate a servo control circuit 39. The servo control circuit 39 functions under the signal from the second register 40 to operate the cylinders 11 through 15 in the boom assembly 2. The movements of the cylinders 11 through 15 are detected by suitable detecting means such as encoders and signals from such detecting means are fed through a feedback circuit 41 including an operation circuits 42 back to the servo control circuit 39 in the form of signals corresponding swinging angles of the booms 8 and 9. The servo control circuit 39 applies its output to a drill control circuit 46 when the drill bit 18*a* is properly located so that the drifter 17 and the motor 20 are operated to drill a bore 5. The control circuit is provided with a bore depth operation circuit 45 which is connected with the outputs of the second register 40 and the operation circuit 42 of the feedback circuit 41. The operation circuit 45 performs an operation based on the drill depth signal from the second register and a signal from the operation circuit 42 which represents the distance $l_{s2}$ between the imaginary drilling plane 22 and the actual rock surface 21 as measured along the direction of the drilling rod 18 to obtain a bore depth. The operation is performed under the following formula.

$$L = L_z - l_{s2} \quad (2)$$

The output of the bore depth operation circuit 45 is applied to the drill control circuit 46 so that desired depth of bore 5 is formed.

Thereafter, the motor 20 is operated under the signal from the drill control circuit 46 to pull the drill rod 18 out of the bore 5. Then, the drill control circuit 46 applies a signal to the processing circuit 35 and the processing circuit 35 then applies a signal to the memory circuit 36 so that the memorized values of a second drill position are addressed. Thus, a second cycle of drilling operation is performed.

Figure 6:
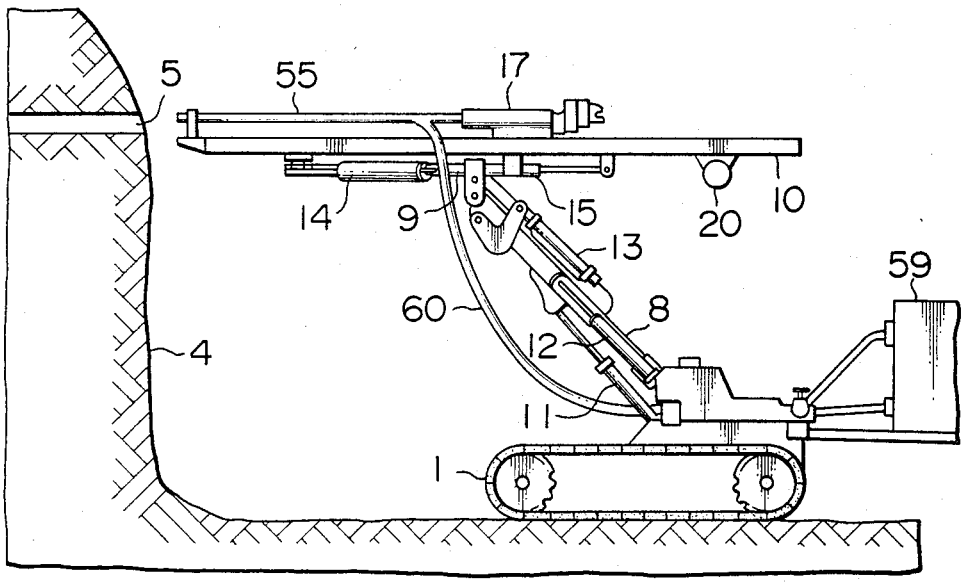
FIG. 6 is a side view of the rock drilling apparatus on which the explosive charging pipe is mounted.
Figure 7:
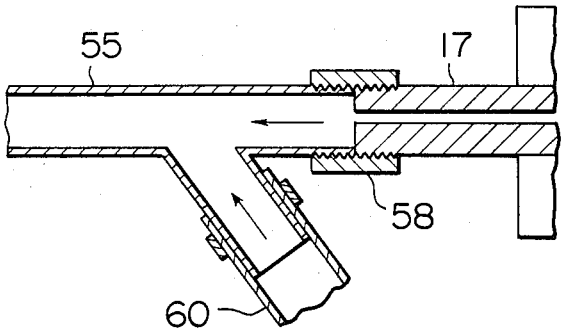
FIG. 7 is a sectional view showing the detail of the explosive charging pipe.

Referring now to FIG. 6, it will be noted that the drilling rod 18 on the guide cell 10 is substituted by an explosive charging pipe 55 which is connected at one end with the drifter 17 by means of a joint sleeve 58 as shown in FIG. 7. The pipe 55 is connected at an end adjacent to the drifter 17 with a hose 60 leading from an explosive feeder 59 provided on the vehicle 1. In charging explosives into the bore 5, the charging pipe 55 is inserted into the bore 5 and explosives are supplied through the hose 60 and the pipe 55 to the bore 6 under a pneumatic force. In inserting the charging pipe 55 into the bore 5 for the purpose, the position and direction of the charging pipe 55 are determined by the control circuit. Thus, the processing circuit 25 applies a signal to the memory circuit 36 so that the memories in the memory circuit 36 is sequentially addressed and passed to the transducer 37 to thereby control the operations of the boom actuating cylinders 11 through 15 under the memories in the memory circuit 36. Then, the drill control circuit 34 functions to operate the advancing motor 20 to advance the drifter 17 and the charging pipe 55 to thereby insert the pipe 55 into the bore 5.

Figure 8:
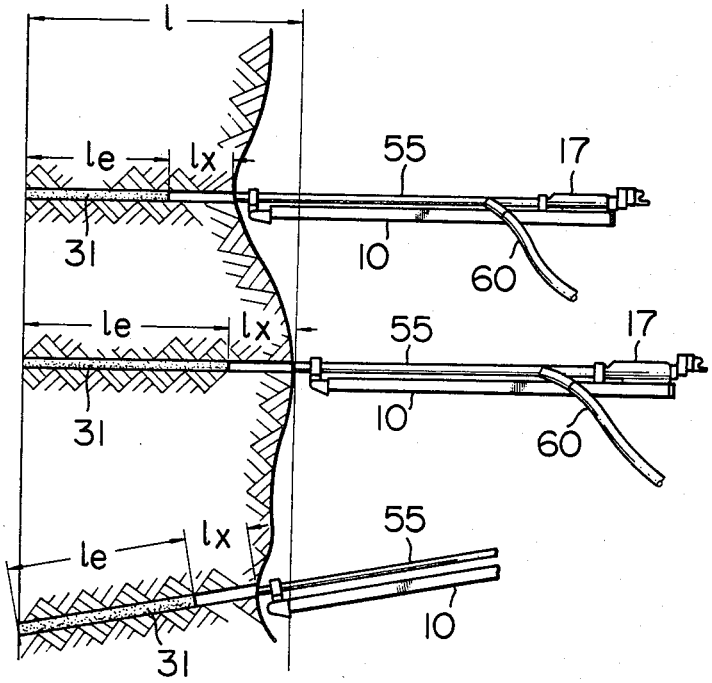
FIG. 8 is a diagrammatical view showing the explosives charged in the bores; and, FIG. 9 is a block diagram showing the circuit for controlling the operation of the rock drilling apparatus.

As shown in FIG. 9, the control circuit includes an explosive feed control circuit 49 which is operated by a signal from the processing circuit 35 to produce a signal which is applied to an explosive feeder drive circuit 50 after the charging pipe 55 is inserted into the drilled bore 5. The output of the drive circuit 50 serves to operate the explosive feeder 59 so that explosives are fed through the hose 60 and the charging pipe 55 into the drilled bore 5. In order to determine the explosive charging depth le as shown in FIG. 8, there is provided a charge depth setting device 47 which stores memories corresponding to the void dpeth lx of the bores 5 which are to be left uncharged with explosives. The output of the setting device 47 is applied to a charge depth operation circuit 48 which is also applied with the output from the bore depth operation circuit 45. The charge depth operation circuit 48 performs an operation based on the bore depth signal from the circuit 45 and the void depth signal from the setting device 47 to produce a charge depth signal corresponding to the charge depth le. The operation is performed under the following formula.

$$le = L - lx \quad (3)$$

The output of the operation circuit 48 is applied to the explosive feed control circuit 49 to control the feeder drive circuit 50.

After the explosives are thus charged in the bore 5, the charging pipe 55 is pulled out of the bore 5 by actuating the motor 20 under the output from the drill control circuit 46 to complete one explosive charging cycle. Then, the cylinders 11 through 15 are operated in accordance with the memories in the memory circuit 36 corresponding to the position of the second bore 5 to locate the charging pipe 55 against the second bore 5 and a second cycle of explosive charging operation is performed. In this manner, explosives are sequentially charged in all of the drilled bores automatically in accordance with the memories in the memory circuit 36.

It will be noted that the charge depth setting circuit 47 may not necessarily store values corresponding to the void depths but may store values corresponding to the percentage charging depths x of respective bores 5. Then, the operation circuit 48 will perform operations under the formula $$le = L \times x \quad x \tag{4}$$

Further, the setting device 47 may contain the value le from the beginning. Then, the operation circuit 48 may be omitted.

The explosive charging device may not necessarily be of the type wherein the charging pipe 55 is mounted on the guide cell 10 in lieu of the drilling rod 18 but another boom assembly may be provided specifically for carrying the explosive charging pipe.

The invention has thus been shown and described with reference to a specific embodiment, however, it should be noted that the invention is in no way limited to the details of the illustrated embodiment but changes and modifications may be made without departing from the scope of the appended claims.

We claim:

1. An explosive charging apparatus for charging controlled amount of explosives sequentially to bores drilled in a rock surface, said charging apparatus including explosive charging means having explosive outlet means, boom means carrying said explosive outlet means of the explosive charging means, boom actuating means for actuating said boom means so that the explosive outlet means of the explosive charging means is moved to a desired position, control circuit means for controlling said boom actuating means and said explosive charging means, said control circuit means including memory means having memories concerning locations, directions and depths of bores drilled in a rock surface, means for addressing memories of one of the bores in said memory means, transducing means for converting the addressed memories in said memory means to values of movements of said boom actuating means, servo control means for receiving outputs from said transducing means and controlling operations of said boom actuating means to locate said explosive outlet means against one of the bores drilled in the rock surface, charge depth setting means for setting a desired depth of explosive charging, charge control means operable upon completion of operation of said servo control means for controlling said explosive charging means so that explosives are charged to the desired depth in accordance with outputs of said charge depth setting means and applying a signal to said addressing means upon completion of explosive charging operation so that memories on another bore are addressed to perform another cycle of operation, said memory means including memories of bottom positions of the bores as the memories concerning the depths of the bores, the charge depth setting means including bore depth operation means for performing operations based on the memories in the memory means to obtain actual bore depths, void depth setting means for setting lengths in the bores where the explosives are not to be charged and charge depth operation means for performing operations based on actual bore depth signals from the bore depth operation means and void depth signals from the void depth setting means to determine charge depths.

2. An explosive charging apparatus for charging controlled amount of explosives sequentially to bores drilled in a rock surface, said charging apparatus including explosive charging means having explosive outlet means, boom means carrying said explosive outlet means of the explosive charging means, boom actuating means for actuating said boom means so that the explosive outlet means of the explosive charging means is moved to a desired position, control circuit means for controlling said boom actuating means and said explosive charging means, said control circuit means including memory means having memories concerning locations, directions and depths of bores drilled in a rock surface, means for addressing memories of one of the bores in said memory means, transducing means for converting the addressed memories in said memory means to values of movements of said boom actuating means, servo control means for receiving outputs from said transducing means and controlling operations of said boom actuating means to locate said explosive outlet means against one of the bores drilled in the rock surface, charge depth setting means for setting a desired depth of explosive charging, charge control means operable upon completion of operation of said servo control means for controlling said explosive charging means so that explosives are charged to the desired depth in accordance with outputs of said charge depth setting means and applying a signal to said addressing means upon completion of explosive charging operation so that memories on another bore are addressed to perform another cycle of operation, said memory means including memories of bottom positions of the bores as the memories concerning the depths of the bores, and the charge depth setting means including bore depth operation means for performing operations based on the memories in the memory means to obtain actual bore depths, said charge depth setting means including percentage depth setting means for setting charge depth in percentage of the bore depth and charge depth operation means for performing operations based on actual bore depth signals from the bore depth operation means and percentage charge depth signals from the percentage depth setting means to determine charge depth.

3. An explosive charging apparatus in accordance with claim 1 in which said memory means includes memories of bottom positions of the bores as the memories concerning the depths of the bores, and the charge depth setting means includes bore depth operation means for performing operations based on the memories in the memory means to obtain actual bore depths, and said charge depth setting means includes percentage depth setting means for setting charge depth in percentage of the bore depth and charge depth operation means for performing operations based on actual bore depth signals from the bore depth operation means and percentage charge depth signals from the percentage depth setting means to determine charge depth.

4. An explosive charging apparatus in accordance with claim 1 in which said explosive outlet means of the explosive charging means includes charging pipe means which is mounted on the boom means for axial sliding movement and the boom actuating means includes an actuator for inserting and retracting the charging pipe means into and out of the bores.

5. A rock drilling apparatus comprising boom means, drilling means mounted on said boom means, first actuator means for moving said boom means so that said drilling means is located against a desired position on a rock surface, second actuator means for advancing and retreating said drilling means to perform drilling operations, memory means memorizing values in rectangular coordinates in an imaginary drilling plane of positions on the rock surface where bores are to be drilled, transducing means for converting the values in the rectangular coordinates memorized in the first memory means into values corresponding to positions of said boom means, servo control means for operating said first actuator means in accordance with signals from said transducing means, feedback means for feeding back values of movements of said boom means to said servo control means, drill control means operable under an output from said servo control means for operating said second actuator means to thereby control movements of said drilling means so that bores of desired depths are drilled, processing means for controlling operations of said memory means so that the values memorized in the memory means are sequentially addressed to thereby perform drilling operations sequentially in the positions on the rock surface where the bores are to be drilled, explosive charging means for charging explosives to the bores drilled in the rock surface, charge depth setting means for setting desired depth of explosive charging, charge control means for controlling said explosive charging means so that explosives are charged to the desired depth in accordance with outputs of said charge depth setting means, said drill control means including bore depth setting means for setting depths of bores to be drilled, said bore depth setting means including bore bottom position setting means for determining distances of bore bottoms from the imaginary drilling plane, drill stroke operation means for performing operations based on said distances between the bore bottoms and the imaginary drilling plane and inclination angles of the respective bores with respect to the imaginary drilling plane to determine drilling strokes of the drilling means, bore depth operation means for performing operations based on the drilling strokes and distances between the imaginary drilling plane and openings of the respective bores at the rock surface to determine actual bore depths, said charge depth setting means including void length setting means for setting lengths from the openings of the respective bores where explosives are not to be charged and charge depth operating means for performing operations based on actual bore signals from the bore depth operation means and void length signals from the void length setting means to determine explosive charge depths.

6. A rock drilling apparatus in accordance with claim 5 in which said explosive charging means includes charging pipe means which is adapted to be mounted on the bottom means in lieu of the drilling means so that the memories in the memory means can be utilized to operate the first actuator means to locate the charge pipe means sequentially against respective ones of the bores.

7. A rock drilling means in accordance with claim 5 in which said boom means includes first boom means mounted on a body of the apparatus for vertical and horizontal swinging movements, second boom means mounted on said first boom means for vertical and horizontal swinging movements and guide cell means mounted on said second boom means for axial sliding movement thereon, said guide cell means being adapted to mount said drilling means and said flow-up work performing means, said first actuating means including actuators for effecting said vertical and horizontal swinging movements of said first and second boom means and said axial sliding movement of said guide cell.

* * * * *